US006866729B2

(12) United States Patent
Gramckow et al.

(10) Patent No.: US 6,866,729 B2
(45) Date of Patent: Mar. 15, 2005

(54) METHOD FOR CONTROLLING AND/OR REGULATING THE COOLING STRETCH OF A HOT STRIP ROLLING MILL FOR ROLLING METAL STRIP, AND CORRESPONDING DEVICE

(75) Inventors: Otto Gramckow, Uttenreuth (DE); Rolf-Martin Rein, Fuerth (DE); Klaus Weinzierl, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 144 days.

(21) Appl. No.: 10/169,183

(22) PCT Filed: Dec. 15, 2000

(86) PCT No.: PCT/DE00/04489

§ 371 (c)(1),
(2), (4) Date: Oct. 4, 2002

(87) PCT Pub. No.: WO01/47648

PCT Pub. Date: Jul. 5, 2001

(65) Prior Publication Data

US 2003/0089431 A1 May 15, 2003

(30) Foreign Application Priority Data

Dec. 27, 1999 (DE) ..... 199 63 186

(51) Int. Cl.[7] ..... B21B 37/76
(52) U.S. Cl. ..... 148/511; 266/87; 266/113
(58) Field of Search ..... 148/511, 654, 148/661; 266/87, 113

(56) References Cited

U.S. PATENT DOCUMENTS 5,891,275 A * 4/1999 Elfmark et al. ..... 148/511
6,430,461 B1 * 8/2002 Andorfer et al. ..... 700/148

FOREIGN PATENT DOCUMENTS

| | | |
|---|---|---|
| DE | 19639062 | 9/1996 |
| DE | 19740691 | 9/1997 |
| WO | WO9505904 | 8/1994 |

OTHER PUBLICATIONS

Sixtensson, P., et al., "New Process Technologies and Automation System for Hot Rolling Mills", Jun. 13–15, 1999; pp. 208–217; XP–001011835,.

Auzinger, Parzer, Neues Prozessoptimierungs–und–steuerungssystem für eine Laminarkühlstrecke, (Dec. 1996) pp. 115–120.

Kirsch, U.A., "Neue Eigenschaftskombination an Grobblech durch den beschleunigten Kühlprozess" (Dec. 1999); pp. 57–65.

* cited by examiner

*Primary Examiner*—Scott Kastler
(74) *Attorney, Agent, or Firm*—Baker Botts LLP

(57) ABSTRACT

A method and device for the automation of a cooling section in a hot strip rolling mill, wherein an individual course of cooling over time for each strip point of the metal strip is specified and whereby the cooling specifications can be determined from the desired properties of the steel, independent of variable process value.

15 Claims, 4 Drawing Sheets

METHOD FOR CONTROLLING AND/OR REGULATING THE COOLING STRETCH OF A HOT STRIP ROLLING MILL FOR ROLLING METAL STRIP, AND CORRESPONDING DEVICE

CROSS-REFERENCE TO RELATED APPLICATIONS

This is a national application for International Application No. PCT/DE00/04489 which was filed on Dec. 15, 2000 and which published in German on Jul. 5, 2001, which in turn claims priority from 199 63 186.7, which was filed on Dec. 27, 1999.

FIELD OF THE INVENTION

The invention relates to a method and associated device for the open-loop and/or closed-loop control of the cooling section of a hot strip rolling mill, in which the microstructural properties of a rolled metal strip, are adjusted by the cooling.

BACKGROUND OF THE INVENTION

In the steel industry, slabs are rolled in the hot state into strips in a hot strip rolling mill. After rolling, the metal sheet runs through a cooling section. The cooling section of the hot strip rolling mill serves to adjust the microstructural properties of the rolled steel strips.

The microstructural properties of the strips produced have previously being derived predominantly from the coiling temperature, which is kept constant at a specified setpoint value by the cooling section automation.

New materials, such as multiphase steels, TRIP steels or the like, require a precisely defined heat treatment, i.e. the specification and monitoring of a temperature profile from the last rolling stand to the coiler.

"Proceedings of ME FEC Kongreβ 99", Dusseldorf, Jun. 13–15, 1999 (Verlag Stahl Eisen GmbH) discloses a proposal for the automation of hot strip rolling mills in which model-supported control is provided specifically for the cooling section. The cooling is based on the idea that a reference temperature can be specified over the length of the entire cooling section and that the temperature measured at a particular time is adapted to the specified values by means of an adaptive control unit. What is important in this case is that the influence of the cooling can be registered in the longitudinal and vertical directions by means of enthalpies observations and dividing the cooling process into a series of smaller thermodynamic processes. In particular, this involves calculation by means of the method of "Finite Elements".

SUMMARY OF THE INVENTION

It is the object of the present invention to provide an improved method and device for the automation of cooling sections in hot strip rolling mills. Accordingly the problems discussed in connection with the prior art are solved, not by specifying the temperature profile along the cooling section as in the prior art, but by specifying an individual course of cooling over time for each strip point of the metal strip. What is particularly advantageous is that cooling specifications can be determined directly from the desired properties of the steel, and independently of variable process values, such as for example the speed of the strip. Consequently, in the method according to the present invention it is important that for each strip point of the material to be cooled, an individual course of cooling is specified. In this way, the determined time functions can be compared at any time for any strip point with the specified time-based cooling curves.

The method according to the present invention has the advantage that cooling conditions which correspond better to the actual conditions dictated by practical circumstances can be specified. It is now possible for variable cooling along the strip also to be specified, whereby regions of specific quality can be produced in the rolled strip in a specifically selective manner. As a result, dual-phase materials can be produced, which was not previously possible.

The fact that the course of cooling is specified for each strip point along the entire cooling section means that the open-loop and/or closed-loop control is no longer tied to fixed switching locations; rather, any desired valves for supplying coolant can be actuated at any time. In order for maintenance of the specified cooling along the cooling section to be checked by the open-loop and/or closed-loop control, according to the present invention, a model is calculated in real-time along with the strip in the cooling section. This provides the required strip temperatures on the cooling section, and is constantly corrected by measured temperature values. Accordingly, this method allows a flexible specification of the heat treatment for modern steels which meets all practical requirements.

The devices which enable the inventive method, include a cooling section which can be subjected to coolants over its entire length by respectively individually adjustable valves, and means for specifying cooling curves for the individual strip points of the metal strip. Also included are units for calculating the cooling curves, for correcting the determined cooling curves on the basis of measured temperatures, for comparing with the specification of the cooling curves, and for generating process control signals. These units can be implemented in a computer by means of software.

BRIEF DESCRIPTION OF THE DRAWINGS

Further details and advantages of the present invention are described in greater detail below in conjunction with exemplary embodiments, and the drawings in which.

DETAILED DESCRIPTION OF THE INVENTION

Figure 1:
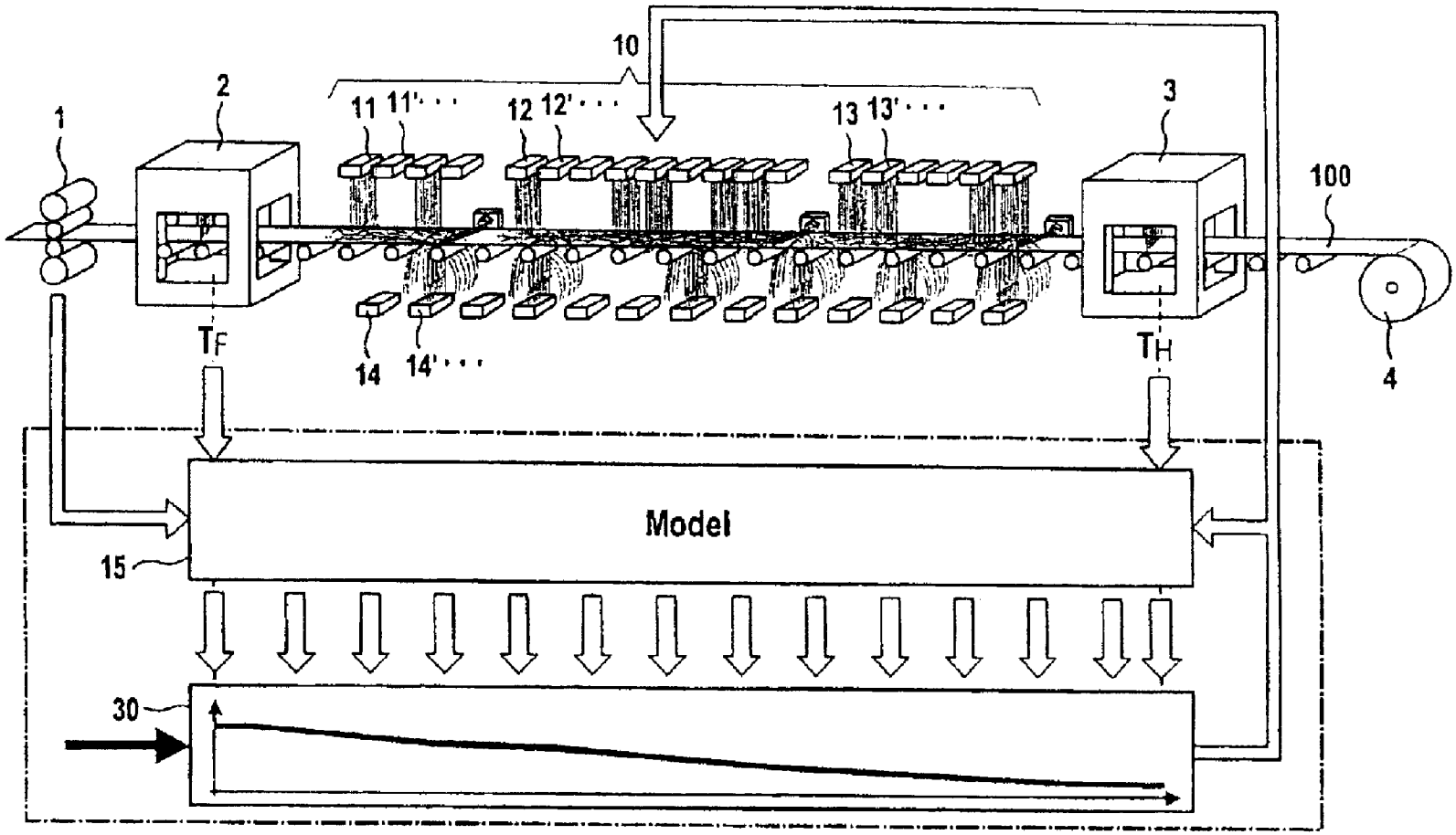
FIG. 1 illustrates the construction of a cooling section arranged downstream of the rolling mill.

The cooling of a metal strip as part of hot rolling technology, and specifically the function of the cooling section in this technology is illustrated in FIG. 1. In the hot rolling of steel, slabs with an initial thickness of about 200 mm are rolled into a strip of 1.5 to 20 mm. The processing temperatures range from between about 800° to 1200° C. After rolling, the processes includes cooling the strip down to about 300° C. to 800° C. in a water cooling section.

In FIG. 1, the last rolling stand 1 of a hot strip rolling mill is followed by a finishing-train measuring station 2, and after the cooling there is a coiler measuring station 3. In these stations the temperature of the strip is measured, and after that there is an underfloor coiler 4 for winding up the metal strip. Between the finishing-train measuring station 2, and the coiler measuring station 3 there is the cooling section 10, which is generally referred to as a system.

A rolled hot strip of steel 100 runs through the cooling section 10 and is cooled on both sides by means of valves with a cooling medium, generally water. Individual valves may be combined into groups, for example the valve groups 11, 11', . . . , 12, 12', . . . , 13, 13', . . . and 14, 14', . . . as indicated.

The cooling of the strip 100 which is to be monitored by a closed-loop control is usually based on a one-dimensional non-steady-state heat conduction equation. The mathematical description is based on an insulated bar which undergoes a heat exchange with the ambience only at the beginning and end, corresponding to the upper side and underside of the strip.

As a basis for the heat conduction in the strip, the model assumes that the heat conduction system diminishes to nothing in the longitudinal and transverse directions, and that the enthalpy is constant over the width of the strip. As a result, any problems can be reduced to a one-dimensional non-steady-state heat conduction problem, in which the initial conditions and the boundary conditions have to be defined.

On the basis of the latter model, the strip 100 can be described by individual strip points, in which a heat conduction takes place in the bar. This is known, by reference to the relevant technical literature.

Generally, no temperatures can be measured in the cooling section 10. However, the temperature is measured at the measuring station 2 upstream of the cooling section, and downstream at the coiler measuring station 3. The heat exchange in the strip 100 is taken into account in the mathematical model in accordance with the above preconditions. Consequently, a model is created of the cooling section, which is denoted in FIG. 1 by the number 15. When the temperatures are available at any desired point via the model 15, closed-loop control to the specified cooling profile can be realized.

Figure 2:
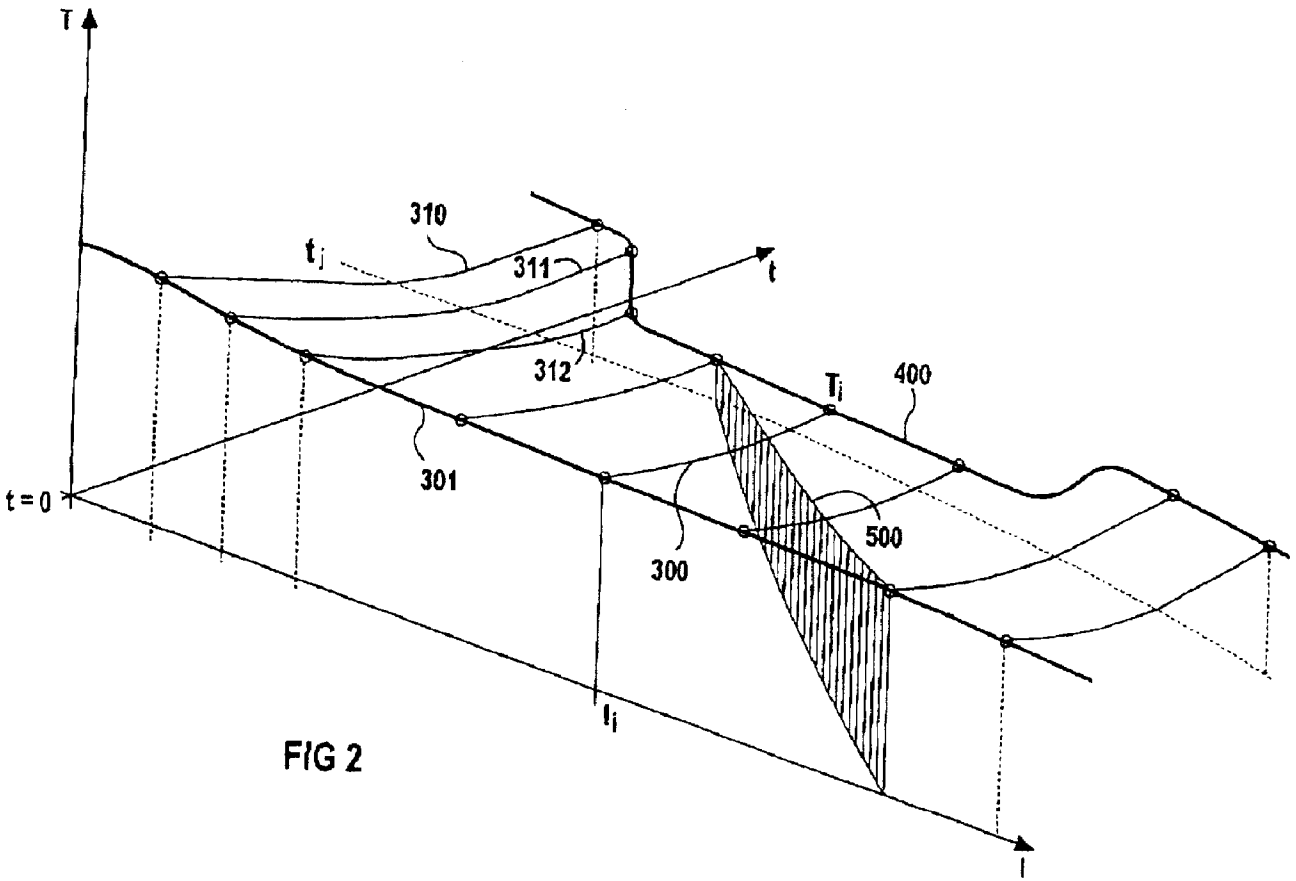
FIG. 2 illustrates a three-dimensional temperature-time/strip-length diagram.

The specification of a course of cooling is shown in FIG. 2 on the basis of a three-dimensional temperature strip-length/time diagram. Proceeding from the start of cooling (t=0) of a strip point, a specified cooling profile 300 is obtained over time t as a time function. FIG. 2 reveals a cooling curve for each strip point of the metal strip 100. For example, the curve 300 for the specific strip point at li is indicated, with its own time function being obtained in this way for this strip point.

For example, the temperature profile for the strip point i after a specific cooling time $t_i$ is intended to have a specified temperature $T_i$, in particular coiling temperature $T_H$. There are also corresponding specifications for the remaining strip points. If all the specified coiling temperatures of the individual strip points are joined, the curve 400 depicted in FIG. 2 is obtained. With this curve 400, it can be ensured for example that method steps such as seizing the strip at the coiler with otherwise the least possible microstructural changes are taken into account.

If at one instant the specifications of all the strip points lying in the cooling section 10 are considered, and these strip points are joined, a curve 500 which represents the cooling profile over the length of the cooling section is obtained. This cooling curve 30 is also depicted in FIG. 1. What is important is that, according to the specified technical teaching, the curve 500 is dynamically adapted automatically when there are disturbances in the production process, for example when there is a variable strip speed. As a result, and in contrast to the prior art, such disturbances remain without any effects on the specified course of cooling of each strip point.

Consequently, it is important in the method of the present invention that each strip point have its own cooling curve, 300, 310, 311, 312 etc. For example, for the first point, a cooling curve with an initially steep descent and subsequently a flatter descent is specified; whereas in the middle region, cooling curves with virtually constant temperature gradients are obtained; with the described profile 400 being achieved overall.

Other cooling profiles can also be produced. In particular, if the microstructure is used as a basis target variable, the profile can be specified in such a way that there are, as far as possible, constant microstructural properties on the finished strip. However, a change in the microstructural properties can also be deliberately provided for specific regions of the strip. For example, microstructural changes caused by the greater lying time of the rear portions of strip can be offset before further rolling.

Since the microstructural properties determine the mechanical properties, and consequently the quality of a steel strip, desired material properties can be achieved by specifically selective microstructural changes. To this extent, the method of the present invention provides an increased potential for the production of finished strip.

Figure 3:
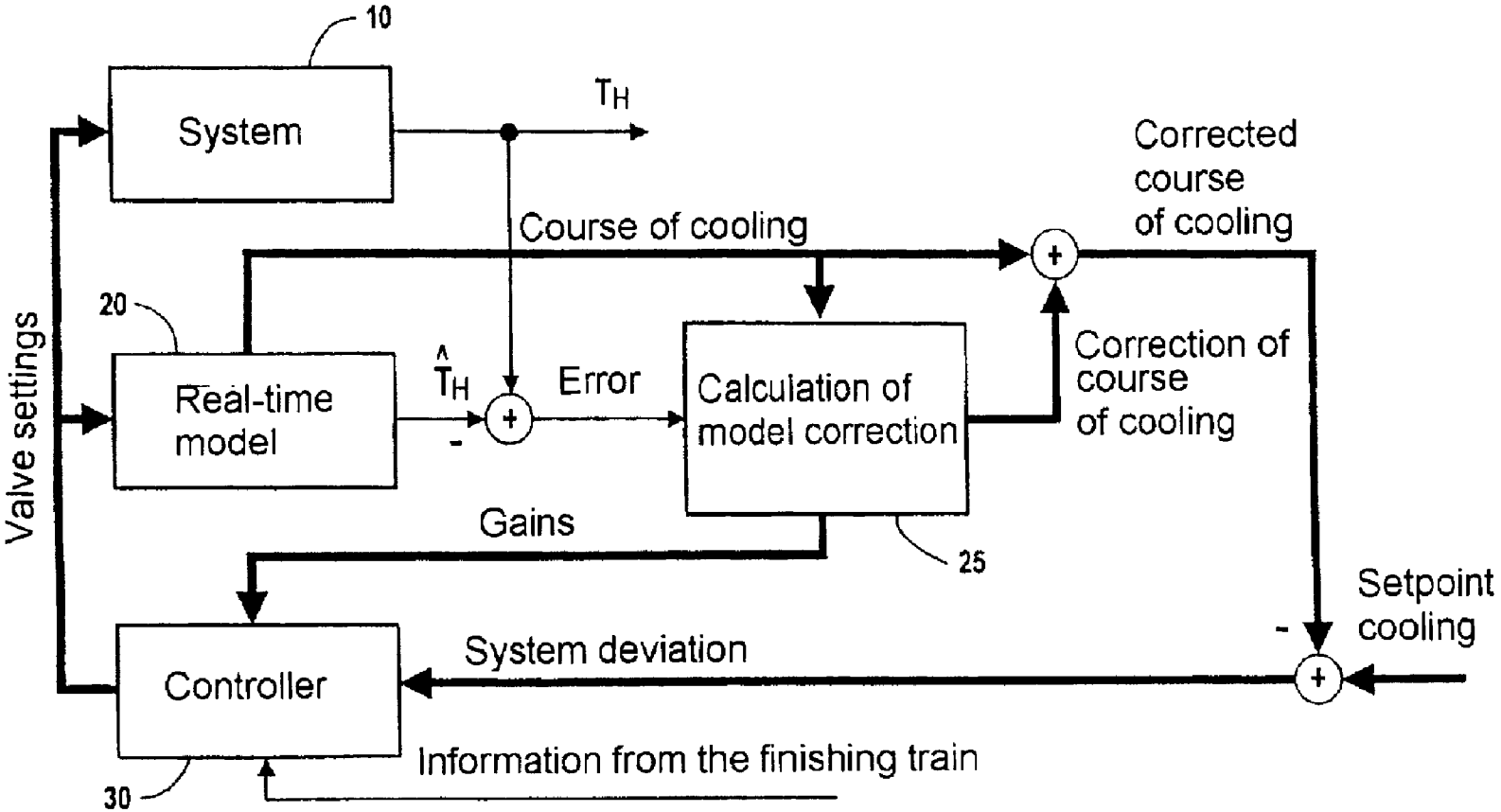
FIG. 3 illustrates the structural diagram of the open-loop/closed-loop control, including model correction for the cooling section according to FIG. 1.

In FIG. 3, the cooling section 10 is shown as an actual system. The model forming FIG. 1 is expressed by a so-called real-time model 20, by means of which the temperatures $\hat{T}_i$ at the individual strip points i of the strip 100 are determined.

The calculated coiling temperature $\hat{T}_H$, which is affected by an error, is compared with the temperature $T_H$ measured at the coiler, and the resulting error is fed to a unit 25 for correction. The unit 25 is also fed the entire cooling process 3, calculated from the real-time model 20. The unit 25 determines from these data a correction of the course of cooling, which is applied to the calculated course of cooling. The corrected course of cooling determined in this way is compared with the setpoint cooling, and the resulting system deviation is fed to the controller 30. The controller 30 thus produces from this information, and by means of the gains determined from the unit 25, the valve settings as process control signals, which are both converted on the system and fed again to the real-time model 20 as information. If no valid measured value is available, the calculation of a corrected course of cooling does not take place. The correction is then assumed to be zero.

The controller 30 can be operated on the basis of the entered system deviation and the further values with a specified algorithm which is specified by means of software, and allows the activation of any desired specifications for the valves. In particular, with the controller 30, each of the valves 11, 11', . . . , 12, 12', . . . , 13, 13', . . . , 14, 14', . . . can be simultaneously activated at any time in any desired combination.

Figure 4:
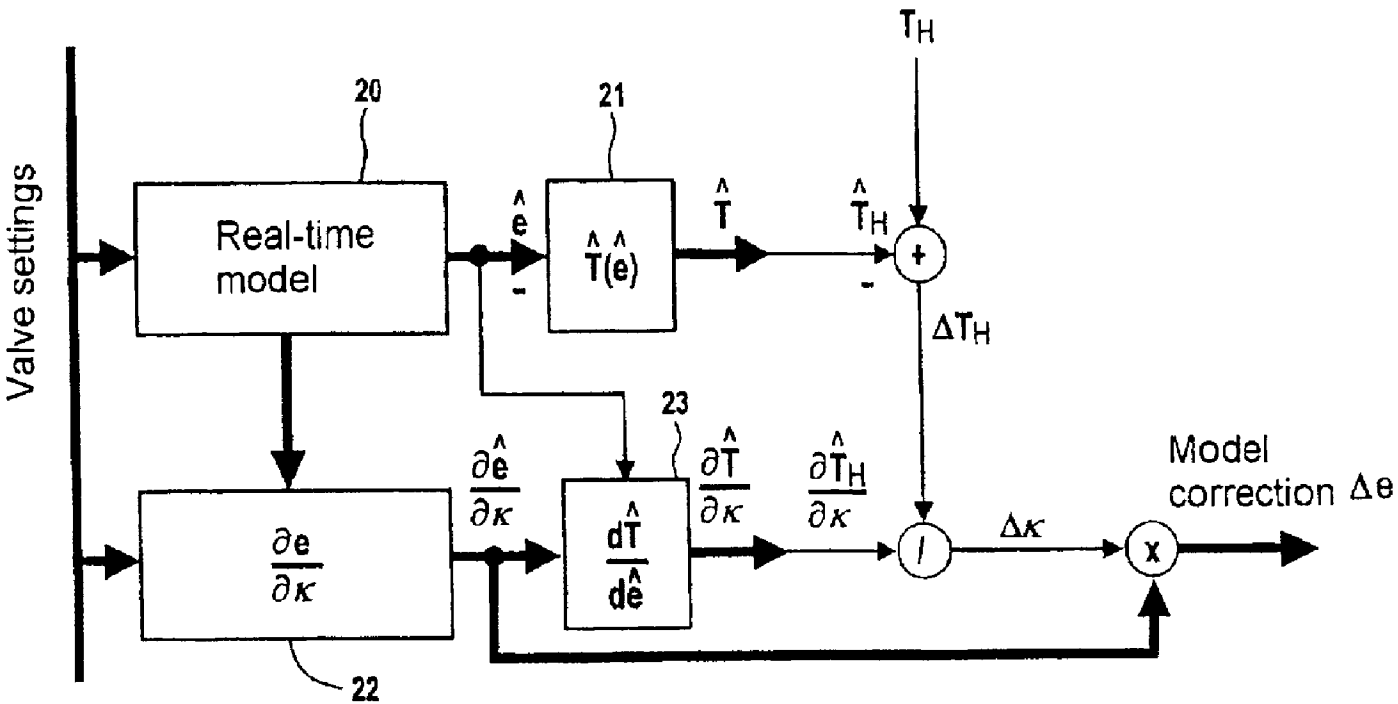
FIG. 4 illustrates the calculation of the model correction from FIG. 3.

The cooling along the metal strip 100 is specifically observed on the basis of the enthalpy, and the temperature variation as a function of the enthalpy. In FIG. 4, the calculation of the model correction for the controller 30 is specifically illustrated. The enthalpies e and the temperatures T are determined as a function of the enthalpy. The real-time model 20 provides a calculated enthalpy value ê, from which the value $\hat{T}(\hat{e})$ is formed in a unit 21. This consequently allows the temperature values $\hat{T}$ to be calculated for any desired strip points. To be specific, the calculated temperature value $\hat{T}_H$ for the coiling temperature is compared with the measured coiling temperature $T_H$, from which a value $\Delta T_H$ is obtained.

From the real-time model 20, enthalpy signals are likewise fed to a unit 22, in which the partial derivative of the enthalpy is formed on the basis of the heat conduction coefficient $$\frac{\partial \hat{e}}{\partial \kappa}.$$

To a certain extent, the heat conduction coefficient represents a correction factor. The valve settings of the system are also entered in both units 20 and 22.

Calculated values $$\frac{\partial \hat{e}}{\partial \kappa}$$

are obtained as the output signal of the unit 22. In unit 23, $$\frac{d\hat{T}}{d\hat{e}}$$

is applied to the signal, allowing a signal $$\frac{\partial \hat{T}}{\partial \kappa}$$

to be determined by the forming of partial derivatives on the basis of the chain rule.

The value for the coiler $$\frac{\partial \hat{T}_H}{\partial \kappa}$$

is considered, and the previously determined temperature error $\Delta T_H$ is divided by this value, producing the $\Delta\kappa$. The latter value $\Delta\kappa$ is multiplied by $$\frac{\partial \hat{e}}{\partial \kappa},$$

so that the model correction $\Delta e$ is obtained as the output value. This provides the model correction of the unit 25 from FIG. 3. In the calculation of the model correction $\Delta e$ according to FIG. 4, $$\frac{\partial \hat{e}}{\partial \kappa}$$

represents a sensitivity model.

It has been found that, with the above procedure, and with consideration of the cooling curves for the individual strip points, the conditions for practical circumstances can be better modeled. The procedure is based on the realization that the heat treatment of modern steels can be individually specified by directly specifying the setpoint curves for the temperature profile of the actual course of cooling for each strip point. To this extent, the interface for the open-loop and/or closed-loop control is the model calculated in real time, and the associated correction algorithm constitutes an essential part of the method described. This procedure takes the specification for the finished material into account in an ideal way, since it ensures the adjustment of the required quality within the limits of the system—independently of the strip speed used.

What is claimed is:

1. A method for an open-loop and/or closed-loop control of a cooling section of a hot strip rolling mill for rolling metal strip, wherein microstructural properties of the rolled metal strip are adjusted by cooling, comprising specifying for each strip point of the metal strip, an individual course of cooling over time, said course of cooling of different strip points having different coiling temperatures; determining for each strip point of the metal strip, an actual cooling curve as a function of time; comparing the determined time function of the actual course of cooling with a specification of the course of cooling over time for each strip point of the metal strip; and deriving process control signals for the control of the cooling section from any deviations of the determined time curves from the actual course of cooling.

2. The method according to claim 1, further comprising specifying different cooling curves for individual strip points of the metal strip.

3. The method according to claim 1, further comprising adjusting desired microstructural properties on the basis of the specified cooling curves for each strip point of the metal strip.

4. The method according to claim 3, farther comprising offsetting any undesired changes in the microstructural properties occurring on account of external influences in the cooling curves specified for the individual strip points of the metal strip.

5. The method according to claim 3, further comprising specifying the cooling curves for the individual strip points of the metal strip so that predetermined, microstructural properties are obtained for different strip points of the metal strip.

6. The method according to claim 5, further comprising specifying mechanical properties of the metal strip on a basis of an influence of a specifically selected microstructural property.

7. The method according to claim 1, further comprising feeding time functions or individual values at a given instant in time during the course of cooling of individual strip points to a controller and generating process control signals therefrom.

8. The method according to claim 7, further comprising using the controller for activating valves for a coolant for cooling the metal strip, wherein any desired valves can be simultaneously activated by the controller at any point in time.

9. The method according to claim 1, further comprising using a measured time function of a coiling temperature as a comparison temperature with the cooling curves of individual strip points.

10. A device for controlling a cooling section of a hot strip rolling mill for rolling metal strip comprising a cooling section, in which a metal strip running there through is contacted with a coolant dispensed from adjustable valves, means for determining temperature-time functions of each individual strip point of the metal strip a process control unit for obtaining process control signals for open-loop and/or closed-loop control of the cooling section in accordance with specified criteria, further comprising means for specifying for each strip point of the metal strip an individual course of cooling over time.

11. The device according to claim 10, wherein the process control unit, is capable of activating each of the individual valves for supplying the coolant at any time.

12. The device according to in claim 10, further comprising a cooling profile for the metal strip in accordance with desired microstructural properties of the metal strip.

13. The device according to claim 10, wherein the process control unit for the open-loop and/or closed-loop control of the cooling is based on a real-time model with a model correction, from which input signals for a controller for activating individual valves are derived.

14. The device according to claim 13, wherein a measured coiling temperature is used for the model correction.

15. The device according to claim 13, wherein a system deviation for the controller is formed from a corrected course of cooling and a setpoint cooling.

* * * * *